US009228450B2

(12) United States Patent
Meyer et al.

(10) Patent No.: US 9,228,450 B2
(45) Date of Patent: Jan. 5, 2016

(54) NOZZLE PARTICLE DEFLECTOR FOR A GAS TURBINE ENGINE

(75) Inventors: Christopher J. Meyer, San Diego, CA (US); Tsuhon Lin, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 770 days.

(21) Appl. No.: 13/540,726

(22) Filed: Jul. 3, 2012

(65) Prior Publication Data

US 2014/0010633 A1 Jan. 9, 2014

(51) Int. Cl.

| | |
|---|---|
| ***F01D 25/00*** | (2006.01) |
| ***F01D 25/12*** | (2006.01) |
| *F01D 9/02* | (2006.01) |

(52) U.S. Cl.

CPC ..... *F01D 25/12* (2013.01); *F05D 2260/607* (2013.01)

(58) Field of Classification Search

CPC ..... F01D 9/065; F01D 21/10; F01D 25/12; F01D 25/32; F05D 2260/607; F04D 29/70; F04D 29/701

USPC ..... 415/115, 116, 121.2, 169.1, 169.4; 60/39.091, 39.092; 55/306

See application file for complete search history.

(56) References Cited

U.S. PATENT DOCUMENTS

| | | | | |
|---|---|---|---|---|
| 3,628,880 | A * | 12/1971 | Smuland et al. | 415/175 |
| 4,820,123 | A | 4/1989 | Hall | |
| 5,142,859 | A * | 9/1992 | Glezer et al. | 60/806 |
| 5,494,402 | A * | 2/1996 | Glezer et al. | 415/115 |
| 7,967,554 | B2 | 6/2011 | Bremer | |
| 2010/0139288 | A1 * | 6/2010 | Rago | 60/785 |

* cited by examiner

*Primary Examiner* — Dwayne J White
*Assistant Examiner* — Alexander White
(74) *Attorney, Agent, or Firm* — Procopio, Cory, Hargreaves & Savitch LLP

(57) ABSTRACT

A particle deflector for a gas turbine engine deters accumulation of particles in cooling passages of nozzle vanes of the engine. The particle deflector is arranged to be disposed around a turbine housing over cooling passages that supply cooling air to nozzle vanes within the housing. The particle deflector includes circumferentially distributed mounting holes for mounting the particle deflector to the turbine housing. The particle deflector also includes circumferentially distributed spacers to space the particle deflector from the housing.

20 Claims, 3 Drawing Sheets

NOZZLE PARTICLE DEFLECTOR FOR A GAS TURBINE ENGINE

TECHNICAL FIELD

The present disclosure generally relates to gas turbine engines and more particularly to a nozzle particle deflector for a gas turbine engine.

BACKGROUND

Gas turbine engines include compressor, combustor, and turbine sections. Portions of a gas turbine engine are subject to high temperatures. In particular, the first sections of the turbine section are subject to such high temperatures that these sections are often cooled by directing relatively cool air through internal cooling passages.

U.S. Pat. No. 4,820,123, to K. Hall, describes a dirt removal means for air cooled blades of a gas turbine engine. The dirt removal means uses louvers stamped out of sheet metal that overlie the inlets of the blades' internal cooling passages. The louvers deflect dirt entrained in cooling air through a high velocity air stream and allow a cleaner portion of the cooling air to flow through the cooling passages of the blades.

SUMMARY OF THE DISCLOSURE

A particle deflector includes a predominantly solid body with mounting holes circumferentially distributed near a first edge of the body and extending through the body; and spacers circumferentially distributed near the first edge of the body. The particle deflector is for use in a gas turbine engine that includes a turbine housing having a generally cylindrical outer surface and having cooling passages arranged to supply cooling air to nozzle vanes within the turbine housing. The mounting holes are for mounting the particle deflector to the turbine housing. The particle deflector is arranged to be located about the turbine housing over the cooling passages, spaced from the turbine housing at the first edge of the body by the spacers, and spaced from the turbine housing at a second edge of the body.

DETAILED DESCRIPTION

Figure 1:
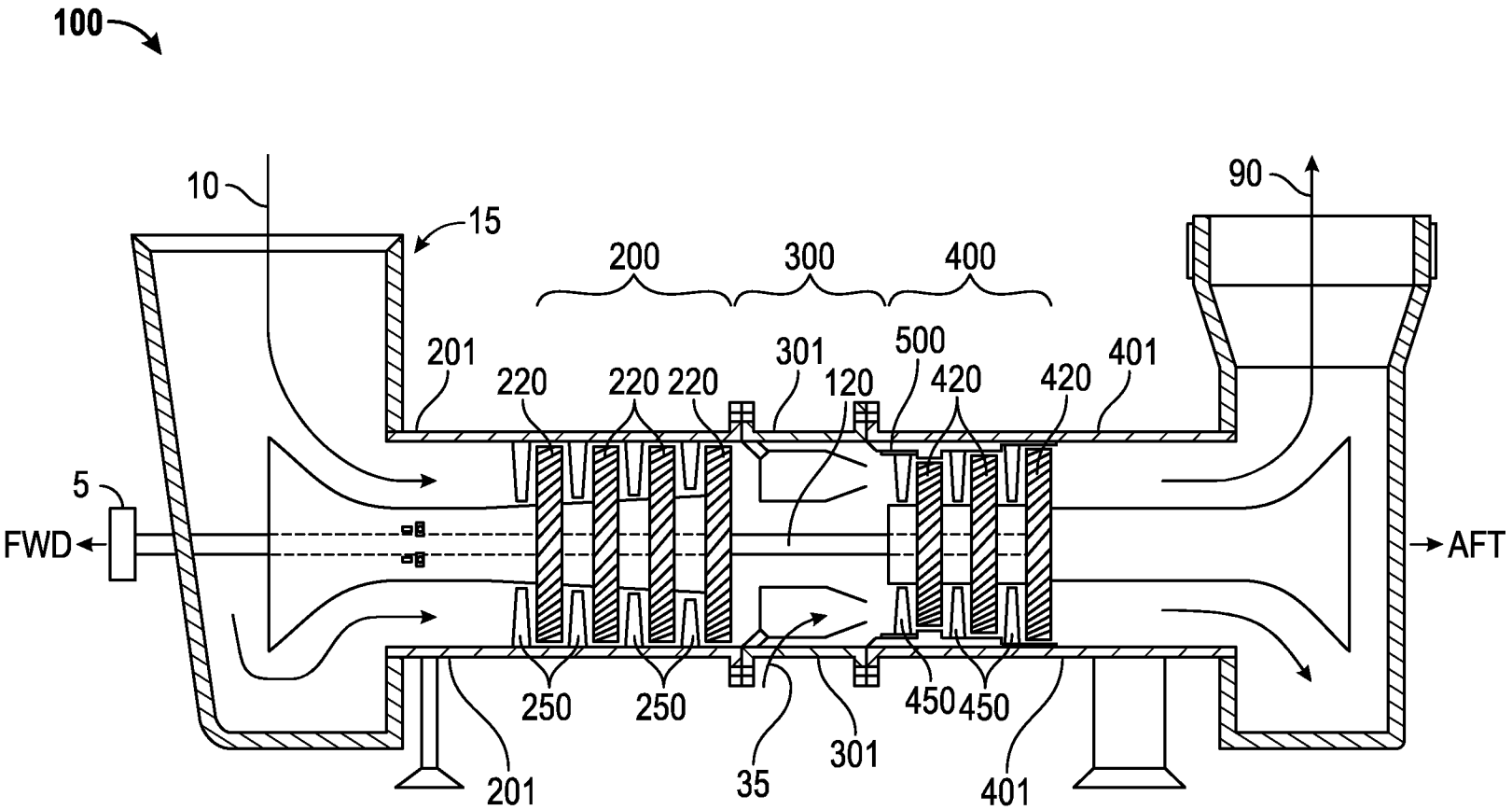
FIG. 1 is a schematic illustration of an exemplary gas turbine engine.

FIG. 1 is a schematic illustration of an exemplary gas turbine engine. A gas turbine engine 100 typically includes a compressor 200, a combustor 300, and a turbine 400. Air 10 enters an inlet 15 as a "working fluid" and is compressed by the compressor 200. Fuel 35 is added to the compressed air in the combustor 300 and then ignited to produce a high energy combustion gas. Energy is extracted from the combusted fuel/air mixture via the turbine 400 and is typically made usable via a power output coupling 5. The power output coupling 5 is shown as being on the forward side of the gas turbine engine 100, but in other configurations it may be provided at the aft end of gas turbine engine 100. Exhaust 90 may exit the system or be further processed (e.g., to reduce harmful emissions or to recover heat from the exhaust).

The compressor 200 includes one or more compressor rotor assemblies 220 mechanically coupled to a shaft 120. The turbine 400 includes one or more turbine rotor assemblies 420 mechanically coupled to the shaft 120. As illustrated, the compressor rotor assemblies 220 and the turbine rotor assemblies 420 are axial flow rotor assemblies, where each rotor assembly includes a rotor disk that is circumferentially populated with a plurality of airfoils ("rotor blades").

Compressor stationary vanes ("stator vanes" or "stators") 250 axially precede each of the compressor rotor assemblies 220. Nozzles 450 axially precede each of the turbine rotor assemblies 420. The nozzles 450 have circumferentially distributed nozzle vanes. The nozzle vanes helically reorient the combustion gas that is delivered to the rotor blades of the turbine rotor assemblies 420 where the energy in the combustion gas is converted to mechanical energy and rotates the shaft 120.

The one of the nozzles 450 closest to the combustor 300 may be considered the first nozzle. The nozzles 450 can be cooled by routing cooling air from the compressor 200. The cooling air is routed through internal passages in the vanes of the nozzles 450. A particle deflector 500 may surround the first one of the nozzles 450 to direct a path of the cooling air.

The various components of the compressor 200 are housed in a compressor case 201 that may be generally cylindrical. The various components of the combustor 300 and the turbine 400 are housed, respectively, in a combustor case 301 and a turbine case 401.

Figure 2:
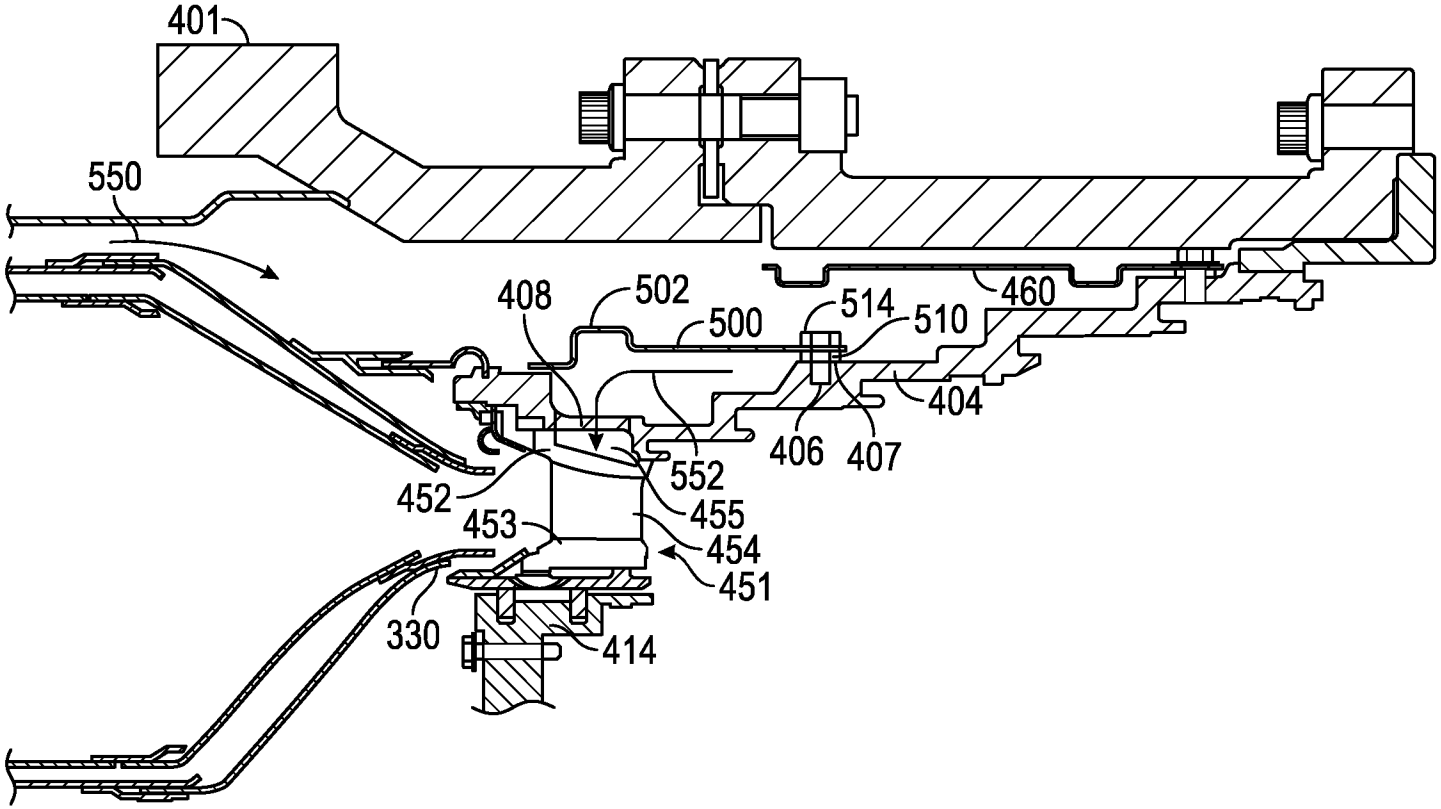
FIG. 2 is a cross-sectional view of a portion of a gas turbine engine having a particle deflector according to an exemplary disclosed embodiment.
Figure 3:
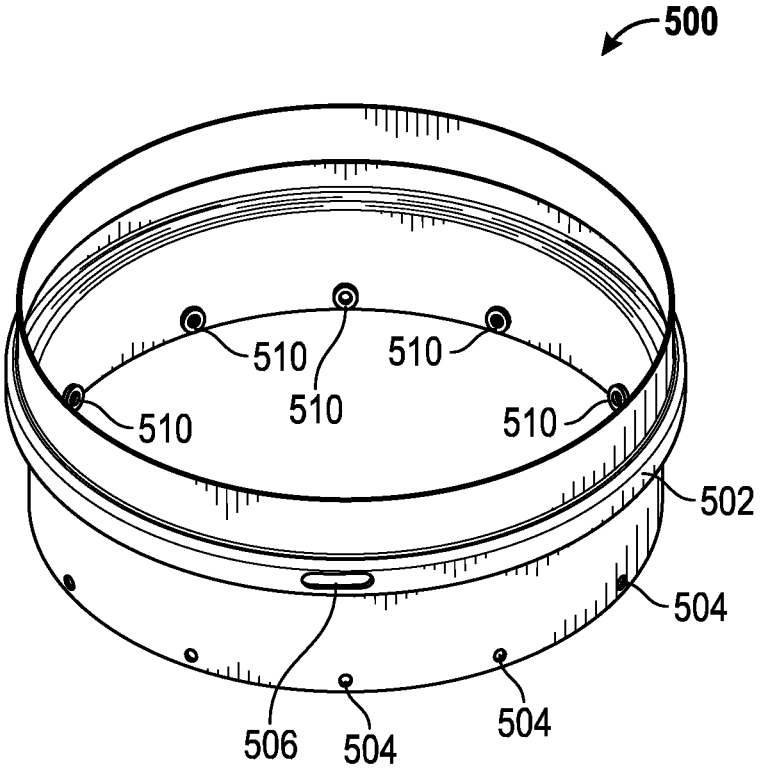
FIG. 3 is a perspective view of a particle deflector according to an exemplary disclosed embodiment.

FIG. 2 is a cross-sectional view of a portion of a gas turbine engine having a particle deflector 500. FIG. 3 is a perspective view of the particle deflector 500. The particle deflector 500 may be used in the gas turbine engine 100 of FIG. 1.

The particle deflector 500 illustrated in FIGS. 2 and 3 is shaped generally as an annular band. Other particle deflectors may have other shapes. The particle deflector 500 is positioned in axial alignment around a turbine housing 404 of the turbine 400 (see FIG. 1). In the embodiment of FIG. 2, the particle deflector 500 covers cooling passages 408 in the turbine housing 404 that provide cooling air to nozzle vanes 451 of the first nozzle.

The nozzle vane 451 includes an outer wall 452 and an inner wall 453 connected by one or more airfoils 454. The outer wall 452 is adjacent to the turbine housing 404. The inner wall 453 is adjacent to a diaphragm 414. The outer wall 452 has openings 455 to provide cooling air to internal passages in the airfoils 454. In the embodiment illustrated in FIG. 2, the cooling passages 408 in the turbine housing 404 overlap at least some of the openings 455 for cooling air to the airfoils 454.

The cooling passages 408 can be circular through holes. The cooling passages 408 are distributed around the turbine housing 404. Each of the cooling passages 408 may supply air to multiple, for example, two, of the airfoils 454.

The particle deflector 500 may also cover openings in the turbine housing 404 that provide cooling air to other components such as nozzle vanes of another nozzle. Additionally, a similar particle deflector may cover openings for cooling of other nozzles. As illustrated in FIG. 2, the gas turbine engine may also include a radiation shield 460. The radiation shield 460 may be similar in form to the particle deflector 500.

A rib 502 may extend outwardly from the particle deflector 500. The rib 502 may have a generally u-shaped cross-section. The rib 502 may have other cross-sectional shapes, for example, a v-shape, rectangular, or semi-circular shape. Regions of the particle deflector 500 fore and aft of the rib 502 may have substantially constant radii. The radius of each region is somewhat greater than a corresponding region of the turbine housing 404. The rib 502 and the regions fore and aft of the rib 502 may considered a body of the particle deflector 500. The body may be predominantly solid.

Mounting holes 504 are distributed around the particle deflector 500 near an aft edge of the particle deflector 500. An exit hole 506 extends through the rib 502. The mounting holes 504 and the exit hole 506 are defined by surrounding portions of the particle deflector 500. In the illustrated embodiment, the exit hole 506 is oval-shaped and is positioned at the bottom of the particle deflector 500 when in a gas turbine engine. In other embodiments, the exit hole 506 may have other shapes, for example, multiple round holes.

The particle deflector 500 is formed, in one embodiment, from sheet metal. An appropriately sized piece is cut from the sheet metal. The mounting holes 504 and the exit hole 506 are then drilled or cut through the piece of sheet metal. The rib 502 is then formed. The sheet is bent into a circular shape. Adjoining edges of the sheet are joined, for example, by welding. The particle deflector 500 may also be formed by other methods.

The particle deflector 500 may be mounted to the turbine housing 404 near the aft edge of the particle deflector 500. The particle deflector 500 is spaced from the turbine housing 404 by spacers 510. The spacers 510 may be positioned at the mounting holes 504. The spacers 510 may be attached, for example, welded, to the particle deflector 500. In various embodiments, the spacers 510 may be rectangular or cylindrical. Away from the spacers 510, the space between the particle deflector 500 and the turbine housing 404 is open.

Threaded holes 406 may be formed in the turbine housing 404 at locations corresponding to the mounting holes 504 of the particle deflector 500. Flats 407 may be machined on the turbine housing 404 about the threaded holes 406. The flats 407 on the turbine housing 404 provide a mating surface to the spacers 510. Bolts 514 secure the particle deflector 500 to the turbine housing 404. Lock tabs can be used to retain the bolts 514. The particle deflector 500 is spaced from the turbine housing 404 at its forward edge.

In an embodiment, the particle deflector 500 is formed of sheet metal that is about 0.063" thick. The metal may be type 410 or 430 stainless steel. The spacers 510 have a thickness of about 0.218". The space between particle deflector 500 and the turbine housing 404 at the forward edge is about 0.050". The exit hole 506 is about 0.325" by 0.112". It should be understood that the foregoing dimensions are exemplary and the particle deflector can have other dimensions. Additionally, the dimensions may vary with temperature.

INDUSTRIAL APPLICABILITY

Operating efficiency of a gas turbine engine generally increases with a higher combustion temperature. Thus, there is a trend in gas turbine engines to increase the temperatures. Gas reaching the nozzle vanes 451 from a combustor outlet 330 may be 1000 degrees Fahrenheit or more.

To operate at such high temperatures, the nozzle vanes 451 have internal cooling passages. A portion of the compressed air from the compressor 200 of the gas turbine engine is diverted from entering the combustor 300 and is routed to the internal cooling passages. The cooling air lowers the temperature of the nozzle vanes 451 so as to deter corrosion, deformation, or melting. The internal cooling passages often include many small holes.

Particles can become entrained in the cooling air. The particles may be ingested by the gas turbine engine from its environment or self-generated within the gas turbine engine. The particles can accumulate in the internal cooling passages and interfere with cooling of the nozzle vanes 451. The small holes in the internal cooling passages can clog and block the flow of cooling air in some areas. Accumulated particles can also cover surfaces in the internal cooling passages and form an insulating layer that reduces cooling effectiveness.

As shown in FIG. 2, an inlet cooling air flow 550 flows in a passage inside the turbine case 401. After passing through the space between the particle deflector 500 and the turbine housing 404, the cooling air enters the nozzle vanes 451 as a nozzle cooling air flow 552.

Some gas turbine engines have used a screen to shield the nozzle vanes 451 from particles. However, the screens themselves are subject to clogging that can block the flow of cooling air to the nozzle and interfere with cooling. Furthermore, the screens are prone to deterioration that can increase the particles reaching the nozzle vanes 451.

The particle deflector 500 creates a torturous path for the cooling air and any entrained particles. The torturous path can avoid accumulation of particles in the internal cooling passages of the nozzle vanes 451 by multiple mechanisms. Some particles are broken into smaller pieces that may pass through the internal cooling passages without accumulating. Other particles may accumulate on or within the particle deflector 500. Still other particles are deflected away from the nozzle vanes 451.

The rib 502 can stiffen the particle deflector 500. The dimensions and location of the rib 502 may be chosen to achieve a high natural frequency of the particle deflector 500. The high natural frequency reduces vibrations that could cause fatigue and cracking of the particle deflector 500.

Some dimensions of the particle deflector 500 may be selected based on the desired rate of cooling air flow. The spacing between the particle deflector 500 and the turbine housing 404 at the forward edge is small so that the air flow is largely regulated by the spacing between the particle deflector 500 and the turbine housing 404 at the aft edge. For example, ninety percent of the nozzle cooling air flow 552 may flow between the aft edge of the particle deflector 500 and the turbine housing 404. In various embodiments, the percentage of the nozzle cooling air flow 552 that flows between the aft edge of the particle deflector 500 and the turbine housing 404 may range from seventy percent to ninety-five percent. The spacing at the aft edge is substantially controlled by the spacers 510.

The spacing between the particle deflector 500 and the turbine housing 404 at the forward edge can be as small as practical while avoiding contact between the particle deflector 500 and the turbine housing 404. Contact between the particle deflector 500 and the turbine housing 404 could lead to fretting or other damage. The spacing includes consideration for variations in the sizes of the particle deflector 500 and the turbine housing 404 including out of roundness. The spacing also includes consideration for vibrations. The spacing also includes consideration for differences in thermal expansion of the particle deflector 500 and the turbine housing 404.

The material for the particle deflector 500 may be chosen in consideration of compatibility with the turbine housing 404. For example, a material with a similar coefficient of thermal expansion may allow a smaller spacing at the forward edge and also reduce thermally induced stresses. When the turbine housing 404 is made of the alloy Incoloy 903, type 410 stainless steel can be used for the particle deflector 500. Additionally, type 410 stainless steel is fatigue resistant.

The exit hole 506 is a small opening. Thus, it does not substantially change the flow of cooling air. For example, in an embodiment, less than five percent of nozzle cooling air flow 552 flows through the exit hole 506. The exit hole 506 is positioned at the bottom of the particle deflector 500 so that particles accumulated within the particle deflector 500 can exit by gravity. Exiting of particles may occur during a shutdown of the gas turbine engine.

The disclosed particle deflector 500 provides a durable solution to deter deterioration of the cooling of the nozzle vanes 451 due to particle contamination. The particle deflector 500 does not materially deteriorate during use. The particle deflector 500 avoids wear surfaces since the particle deflector 500 is fixed to the turbine housing 404. Air flow from the inlet cooling air flow 550 to the nozzle cooling air flow 552 encounters a limited and substantially constant pressure drop due to the particle deflector 500. Thus, a substantially uniform cooling air distribution to the nozzle vanes 451 can be maintained.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular particle deflector, it will be appreciated that particle deflectors in accordance with this disclosure can be implemented in various other configurations and used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A particle deflector for a gas turbine engine including a turbine housing having a generally cylindrical outer surface and having cooling passages arranged to supply cooling air to nozzle vanes within the turbine housing, the particle deflector comprising:

a predominantly solid body having mounting holes circumferentially distributed near a first edge of the body and extending through the body for mounting the particle deflector to the turbine housing;

a rib extending radially outward from the body; and spacers circumferentially distributed near the first edge of the body, the particle deflector configured to be disposed about the turbine housing over the cooling passages, to be spaced from the turbine housing at the first edge of the body by the spacers, and to be spaced from the turbine housing at a second edge of the body.

2. The particle deflector of claim 1, wherein at least part of the particle deflector is formed of sheet metal.

3. The particle deflector of claim 1, wherein the rib has a u-shaped cross-section.

4. The particle deflector of claim 1, further comprising an exit hole in the rib.

5. The particle deflector of claim 1, wherein the particle deflector is arranged to be secured to the turbine housing by bolts extending through the mounting holes and into the turbine housing.

6. The particle deflector of claim 5, wherein the spacers are disposed at the mounting holes and are arranged for the bolts to extend through the spacers.

7. The particle deflector of claim 1, wherein the spacers are arranged to contact the turbine housing at corresponding flats on the outer surface of the turbine housing.

8. The particle deflector of claim 1, wherein the particle deflector and the turbine housing are formed of materials having similar coefficients of thermal expansion.

9. The particle deflector of claim 1, wherein the cooling air to the nozzle vanes flows largely between the first edge of the body of the particle deflector and the turbine housing.

10. A particle deflector for a gas turbine engine including a turbine housing having a generally cylindrical outer surface and having cooling passages arranged to supply cooling air to nozzle vanes within the turbine housing, the particle deflector comprising:

an annular band configured to be disposed around the turbine housing over the cooling passages to create a torturous path for the cooling air to enter the cooling passages;

mounting holes circumferentially distributed near a first edge of the annular band and extending through the annular band for mounting the particle deflector to the turbine housing;

spacers circumferentially distributed near the first edge of the annular band, the particle deflector is configured to be spaced from the turbine housing at the first edge of the annular band by the spacers and spaced from the turbine housing at a second edge of the annular band, wherein the cooling air to the nozzle vanes flows largely between the first edge of the particle deflector and the turbine housing; and an exit hole proximate a bottom of the particle deflector.

11. The particle deflector of claim 10, wherein at least part of the particle deflector is formed of sheet metal.

12. The particle deflector of claim 10, further comprising a rib extending radially outward from the annular band, wherein the exit hole is located in the rib.

13. The particle deflector of claim 12, wherein the rib has a u-shaped cross-section.

14. The particle deflector of claim 10, wherein the spacers are disposed at the mounting holes and arranged to contact the turbine housing at corresponding flats on the outer surface of the turbine housing, and wherein the particle deflector is arranged to be secured to the turbine housing by bolts extending into the turbine housing through the mounting holes and the spacers.

15. The particle deflector of claim 10, wherein the particle deflector and the turbine housing are formed of materials having similar coefficients of thermal expansion.

16. A gas turbine engine, comprising:

a turbine housing having a generally cylindrical outer surface and having cooling passages arranged to supply cooling air to nozzle vanes within the turbine housing; and a particle deflector having a predominantly solid body, the body having mounting holes circumferentially distributed near a first edge of the body and extending through the body for mounting the particle deflector to the turbine housing;

a rib extending radially outward from the body; and spacers at the mounting holes, the particle deflector being disposed about the turbine housing at the cooling passages, spaced from the turbine housing at the first edge of the body by the spacers, and spaced from the turbine housing at a second edge of the body.

17. The gas turbine engine of claim 16, wherein at least part of the particle deflector is formed of sheet metal.

18. The gas turbine engine of claim 16, further comprising an exit hole in the rib.

19. The gas turbine engine of claim 16, wherein the particle deflector is arranged to be secured to the turbine housing by bolts extending through the mounting holes and into the turbine housing.

20. The gas turbine engine of claim 16, wherein the spacers are arranged to contact the turbine housing at corresponding flats on the outer surface of the turbine housing.

* * * * *